US005515687A

United States Patent [19]

Arriulou

[11] Patent Number: 5,515,687

[45] Date of Patent: May 14, 1996

[54] PROCESS AND INSTALLATION FOR THE PRODUCTION OF OXYGEN AND/OR NITROGEN UNDER PRESSURE

[75] Inventor: Pascal Arriulou, Saint Maurice, France

[73] Assignee: L'Air Liquide, Societe Anonyme pour l'Etude et l'Exploitation des Procedes Georges Claude, Paris Cedex, France

[21] Appl. No.: 329,321

[22] Filed: Oct. 26, 1994

[30] Foreign Application Priority Data

Oct. 26, 1993 [FR] France ..... 93 12729

[51] Int. Cl.[6] ..... F25J 3/00

[52] U.S. Cl. ..... 62/646; 62/654

[58] Field of Search ..... 62/38, 41

[56] References Cited

U.S. PATENT DOCUMENTS

| | | | |
|---|---|---|---|
| 4,152,130 | 5/1979 | Theobald | 62/38 X |
| 4,303,428 | 12/1981 | Vandenbussche | 62/38 X |
| 4,356,013 | 10/1982 | Linde et al. | 62/38 X |
| 4,375,367 | 3/1983 | Prentice | 62/38 X |
| 4,705,548 | 11/1987 | Agrawal et al. | 62/38 X |
| 4,883,518 | 11/1989 | Skolaude et al. | 62/38 |
| 5,157,926 | 10/1992 | Guilleminot | 62/38 X |
| 5,329,776 | 7/1994 | Grenier | 62/41 X |
| 5,355,681 | 10/1994 | Xu | 62/41 X |
| 5,355,682 | 10/1994 | Agrawal et al. | 62/41 |
| 5,379,598 | 1/1995 | Mostello | 62/41 X |

FOREIGN PATENT DOCUMENTS

| | | |
|---|---|---|
| 0542539 | 5/1993 | European Pat. Off. . |
| 2690982 | 11/1993 | France . |
| 2251931 | 7/1992 | Germany . |

*Primary Examiner*—Christopher Kilner
*Attorney, Agent, or Firm*—Young & Thompson

[57] ABSTRACT

In this process for the distillation of air, of the type with a liquid oxygen pump (14) and with the vaporization of liquid oxygen under pressure, there are used, in addition to a principal compressor (1), at least three further compressors (9 to 11 ), of which two (9, 10) are mounted in series and supply the heat exchange line with air at a high pressure of the vaporization of oxygen. Air is withdrawn between these two further compressors, expanded to the medium pressure and introduced at the base of the medium pressure column (5), and at least one (11) of the three further compressors consumes the mechanical energy developed by the turbine (12).

26 Claims, 2 Drawing Sheets

Figure 1:
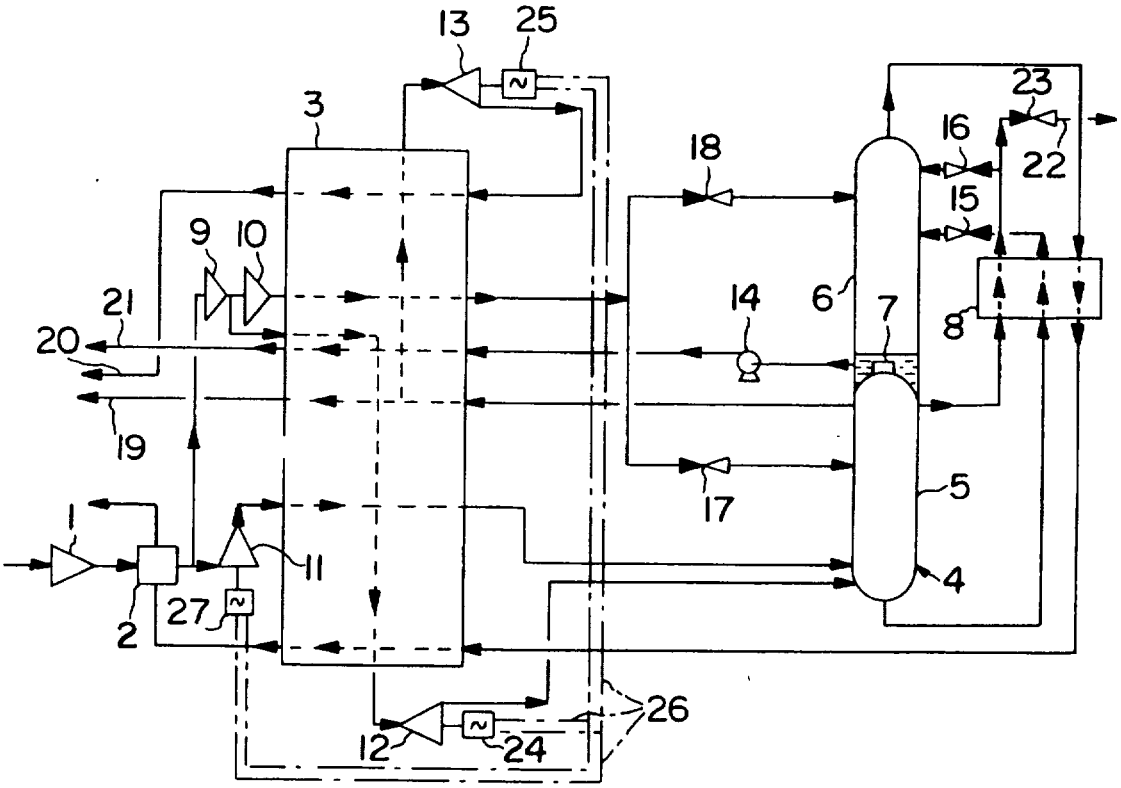

PROCESS AND INSTALLATION FOR THE PRODUCTION OF OXYGEN AND/OR NITROGEN UNDER PRESSURE

The present invention relates to a process for the production of gaseous oxygen and/or nitrogen under pressure by distillation of air in an installation comprising a principal air compressor, apparatus for purifying air by adsorption, a heat exchange line and a double air distillation column comprising a medium pressure column and a low pressure column, of the type in which liquid oxygen and/or nitrogen is withdrawn from the low pressure column, compressed by pumping, and vaporized under pressure by heat exchange with the air compressed by the principal compressor and then further compressed.

The invention has for its object to provide a process of this type having particularly high energy performance.

To this end, the invention has for its object a process of the recited type, characterized in that:

said further compression is effected by means of at least two further compressors in series;

air is withdrawn between these two further compressors, expanded in a Claude turbine to the medium pressure and introduced into the base of the medium pressure column; and a flow of air under a pressure at least equal to the output pressure of the principal compressor is further compressed by a third of the further compressors.

This process can comprise one or several of the following characteristics:

the third further compressor is mounted between the principal compressor and the medium pressure column;

the third further compressor is mounted between the principal compressor and the first of the two further compressors in series;

the third further compressor is mounted between the first of the two further compressors in series and the turbine;

nitrogen withdrawn from the head of the medium pressure column is expanded in the second turbine;

at least one of the three further compressors consumes the mechanical energy developed by the Claude turbine and/or by the nitrogen expansion turbine.

The invention has also for its object an installation adapted to practice such a process. This installation, of the type comprising a principal air compressor, an apparatus for the purification of air by adsorption, a heat exchange line, a double distillation column comprising a medium pressure column and a low pressure column, a pump connected upstream of the double column and downstream of the oxygen and/or nitrogen vaporization passages of the heat exchange line, and means for further compressing air supplied by the principal compressor and opening into the air cooling passages of the heat exchange line, is characterized in that:

the further compressing means comprise at least two further compressors in series;

a conduit tapping between these two further compressors supplies a Claude turbine for the expansion of air to the medium pressure whose outlet is connected to the base of the medium pressure column; and the installation comprises a third further compressor supplied by air under a pressure at least equal to the output compressor of the principal compressor.

Figure 2:
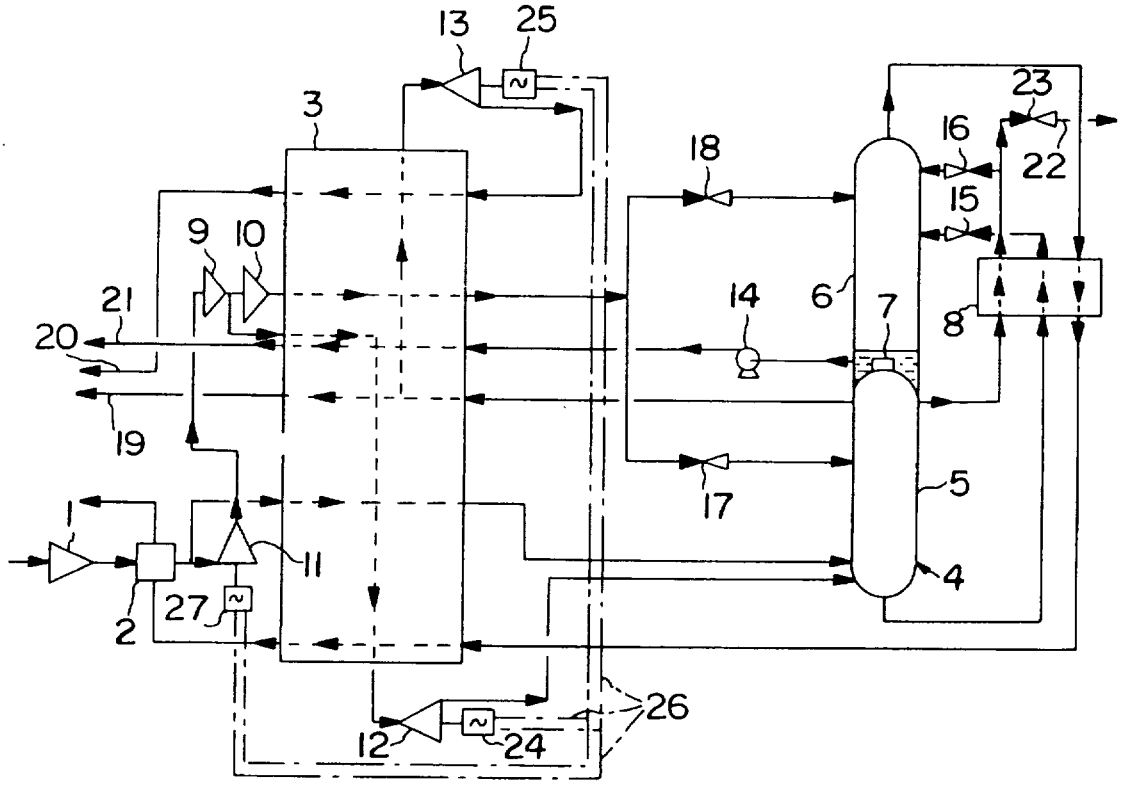
Figure 3:
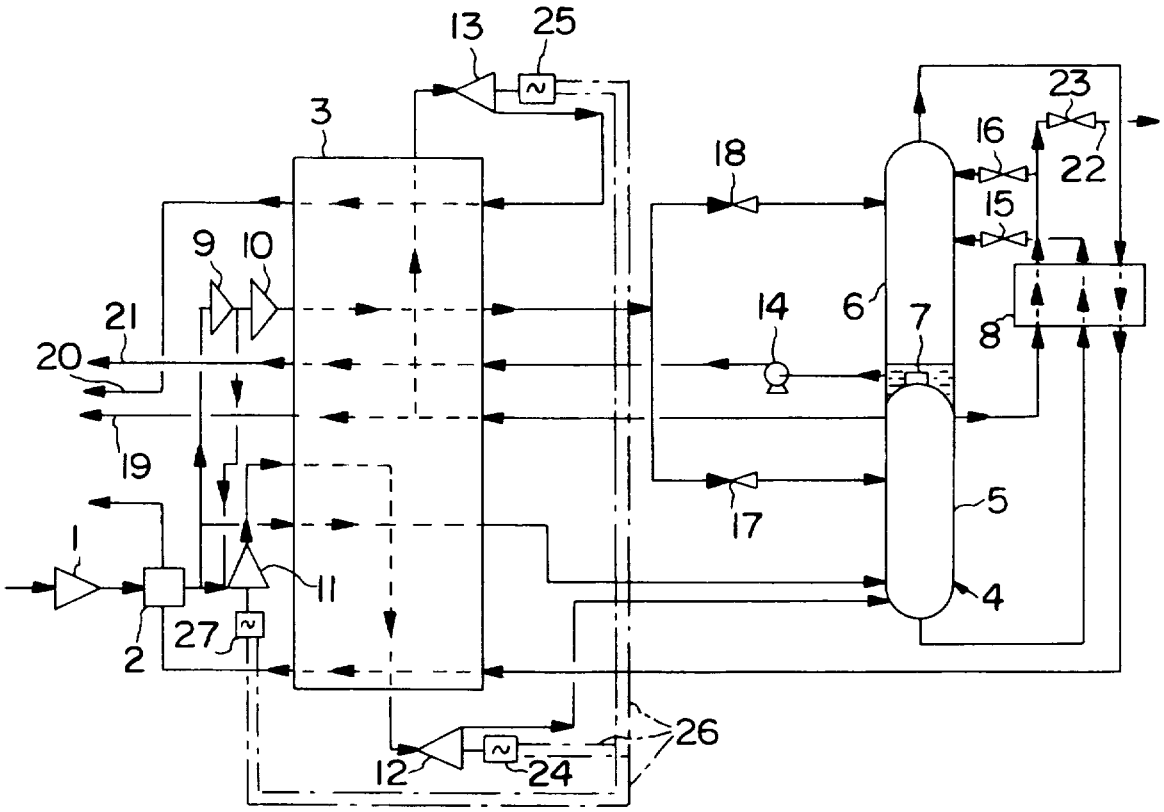

Examples of the practice of the invention will now be described with respect to the accompanying drawings, in which:

FIGS. 1 to 3 show respectively, in schematic fashion, three embodiments of the installation according to the invention.

The installation for the production of gaseous oxygen under pressure shown in FIG. 1 comprises essentially: a principal air compressor 1; an apparatus 2 for the purification of air from water and carbon dioxide by adsorption; a heat exchange line 3 adapted to cool the air to be treated by indirect countercurrent heat exchange with cold products; an air distillation apparatus 4 of the double column type, constituted essentially by a medium pressure column 5 surmounted by a low pressure column 6, with a vaporizer-condenser 7 that places in indirect heat exchange the head vapor (nitrogen) of the column 5 and the bottom liquid (oxygen) of the column 6; a subcooler 8; two further air compressors 9 and 10 in series, driven by an external energy source (not represented); a third further compressor 11; an air expansion turbine 12; a nitrogen expansion turbine 13; and a liquid oxygen pump 14.

The air to be treated, compressed in the compressor 1, is dried and freed from carbon dioxide in the apparatus 2. A portion of this air, after further compression in 11, enters the heat exchange line 3 and is cooled to about its dew point. This air then enters the medium pressure column 5, where it is separated into a "rich liquid" (air enriched in oxygen) and nitrogen. The rich liquid and the liquid nitrogen withdrawn at the head of column 5 are subcooled in the subcooler 8 by the low pressure impure nitrogen produced in the head of column 6, then, after expansion in respective expansion valves 15 and 16, supply this low pressure column 6. After reheating in 8 and then in 3, the impure low pressure nitrogen, at ambient temperature, is used to regenerate the adsorbent of the apparatus 2.

The rest of the purified air is further compressed in 9, then divided into two streams: a first stream is again further compressed in 10, to a high air pressure, introduced into the heat exchange line 3, cooled and then liquefied in this latter, then divided into two flows which, after expansion in respective expansion valves 17 and 18, supply respectively the columns 5 and 6.

The second air stream from the further compressor 9 is cooled in 3 to an intermediate temperature, then expanded to the medium pressure in the turbine 12 before being sent to the base of the column 5.

Moreover, gaseous nitrogen withdrawn from the head of column 5 is, after partial reheating in 3, divided into a first production nitrogen stream, which is reheated to ambient temperature and then recovered via a conduit 19, and a second stream which, after expansion in 13 to about atmospheric pressure, is reheated to the ambient temperature 3, then recovered via a conduit 20.

The product oxygen is withdrawn in the form of liquid from the base of the low pressure column 6, brought in 14 to the production pressure, vaporized by heat exchange with high pressure air in 3, reheated to the ambient temperature and recovered in the form of gaseous product oxygen via a conduit 21.

There is also indicated in FIG. 1 a conduit 22 for liquid nitrogen product, tapped between the subcooler 8 and the expansion valve 16 and itself provided with an expansion valve 23.

The turbine 12 is braked by an alternator 24 and, likewise, the turbine 13 is braked by an alternator 25. Electric lines 26 connect these two alternators to a motor 27 for driving the further compressor 11.

The installation thus described permits optimizing the heat exchange diagram of the heat exchange line 3, particularly by obtaining temperature differences particularly reduced within the cold portion of the latter.

Moreover, it will be noted that it is the air further compressed in 11 which is at the medium pressure of about 5 bars, such that the compressor 1 need only bring the atmospheric air to a pressure substantially less than 5 bars, for example of the order of 3 bars, and can therefore be constituted by a very simple apparatus such as a blast furnace blower. An important capital saving is obtained in this manner.

The installation shown in FIG. 2 differs from that of FIG. 1 only by the fact that the further compressor 11 is mounted between the purification apparatus 2 and the further compressor 9, while the outlet of this apparatus is directly connected to the heat exchange line and, from there, to the base of the medium pressure column. Of course, in this case, the compressor 1 must compress the air to the medium pressure, and the saving of compressive work is shifted onto the further compressor 9.

The installation of FIG. 3 differs from the preceding only by the fact that the further compressor 11 is mounted between the output of the further compressor 9 and the heat exchange line 3, such that the further compressor 9 is supplied by air under the medium pressure leaving the purification apparatus 2.

The advantage of this arrangement is the gain in refrigeration which it permits obtaining thanks to the expansion of air in the turbine 12.

As a modification, in each of the configurations described above, the turbine rotors could be keyed to the same shaft as the further compressor 11, in which case the alternators 24, 25 and the motor 27 are omitted. It may then be preferable to replace the further compressor 11 by two further compressors in series whose rotors are coupled one to that of the turbine 12 and the other to that of the turbine 13.

In the preceding, it should be understood that the expression "two further compressors in series" can include the case of a single further compressor with two compression stages. In the case of further compressors 9 and 10, the intermediate withdrawal conduit is in that case an inter-stage withdrawal conduit.

The invention could also be used for the production of gaseous nitrogen under a pressure higher than the medium pressure.

I claim:

1. In a process for the production of at least one of gaseous oxygen and nitrogen under pressure by distillation of air in an installation comprising a principal air compressor, an apparatus for the purification of air by adsorption, a heat exchange line and a double air distillation column comprising a medium pressure column and a low pressure column, wherein at least one of liquid oxygen and nitrogen is withdrawn from the double column, compressed by pumping, and vaporized under pressure by heat exchange with the air compressed by the principal compressor then further compressed; the improvement wherein said further compression is effected by means of first and second compressors in series; air is withdrawn between said first and second compressors, expanded in a Claude turbine to the medium pressure and introduced into the base of the medium pressure column; a flow of air under a pressure equal to the output pressure of the principal compressor is further compressed by a third compressor, and the inlet temperature of the second compressor is in the region of atmospheric temperatures.

2. A process according to claim 1, wherein the third compressor is mounted between the principal compressor and the medium pressure column.

3. A process according to claim 1, wherein the third compressor is mounted between the principal compressor and the first compressor.

4. A process according to claim 1, wherein the third compressor is mounted between the first compressor and the Claude turbine.

5. A process according to claim 1, wherein nitrogen withdrawn from the head of the medium pressure column is expanded in a second turbine.

6. A process according to claim 5, wherein at least one of the first through the third compressors consumes the mechanical energy developed by at least one of the Claude turbine and the second turbine.

7. A process according to claim 6, wherein the mechanical energy developed by at least one of the Claude turbine and the second turbine is consumed by said third compressor.

8. In a process for the production of at least one of gaseous oxygen and nitrogen under pressure by distillation of air in an installation comprising a principal air compressor, an apparatus for the purification of air by adsorption, a heat exchange line and a double air distillation column comprising a medium pressure column and a low pressure column, wherein at least one of liquid oxygen and nitrogen is withdrawn from the double column, compressed by pumping, and vaporized under pressure by heat exchange with the air compressed by the principal compressor then further compressed; the improvement wherein said further compression is effected by means of first and second compressors, in series; and air is withdrawn between said first and second compressors, compressed in a third compressor, expanded in a Claude turbine to the medium pressure and introduced into the base of the medium pressure column.

9. A process according to claim 8, wherein the third compressor is mounted between the principal compressor and the medium pressure column.

10. A process according to claim 9, wherein the third compressor is mounted between the first compressor and the turbine.

11. A process according to claim 8, wherein nitrogen withdrawn from the head of the medium pressure column is expanded in a second turbine.

12. A process according to claim 11, wherein at least one of the first through the third compressors consumes the mechanical energy developed by at least one of the Claude turbine and the second turbine.

13. A process according to claim 12, wherein the mechanical energy developed by at least one of the Claude turbine and the second turbine is consumed by said third compressor.

14. In an installation for the production of at least one of gaseous oxygen and nitrogen under pressure by distillation of air comprising a principal air compressor, an apparatus for the purification of air by adsorption, a heat exchange line, a double air distillation column comprising a medium pressure column and a low pressure column, a pump connected upstream of the double column and downstream of vaporization passages of the heat exchange line, and means for further compressing air supplied by the principal compressor and emptying into the air cooling passages of the heat exchange line; the improvement wherein the further compression means comprise at least first and second compressors in series; a conduit tapped between said first and second compressors supplied a Claude turbine for the expansion of air to the medium pressure column; and the installation comprises a third compressor supplied by air under a pressure equal to the output pressure of the principal compressor, said third compressor being directly connected to the outlet of the principal compressor and said second compressor being connected upstream of said heat exchange line.

15. An installation according to claim 14, wherein the third compressor is mounted between the principal compressor and the medium pressure column.

16. An installation according to claim 14, wherein the third compressor is mounted between the principal compressor and the first compressor.

17. An installation according to claim 14, wherein the third compressor is mounted between the first compressor and the Claude turbine.

18. An installation according to claim 14, which further comprises a second turbine for the expansion of nitrogen connected upstream of the head of the medium pressure column.

19. An installation according to claim 18, wherein at least one of the first through the third compressors is driven by the mechanical energy developed by at least one of the Claude turbine and the second turbine.

20. An installation according to claim 19, wherein said third compressor is driven by the mechanical energy developed by at least one of the Claude turbine and the second turbine.

21. In an installation for the production of at least one of gaseous oxygen and nitrogen under pressure by distillation of air a principal air compressor, an apparatus for the purification of air by adsorption, a heat exchange line, a double air distillation column comprising a medium pressure column and a low pressure column, a pump connected upstream of the double column and downstream of vaporization passages of the heat exchange line, and means for further compressing air supplied by the principal compressor and emptying into the air cooling passages of the heat exchange line; the improvement wherein the further compression means comprise at least first and second compressors in series; a conduit tapped between said first and second compressors supplies a third compressor whose outlet is connected to the inlet of a Claude turbine for the expansion of air to the medium pressure whose output is connected to the base of the medium pressure column.

22. An installation according to claim 21, wherein the third compressor is mounted between the principal compressor and the medium pressure column.

23. An installation according to claim 22, wherein the third compressor is mounted between the first compressor and the Claude turbine.

24. An installation according to claim 21, which further comprises a second turbine for the expansion of nitrogen connected upstream of the head of the medium pressure column.

25. An installation according to claim 24, wherein at least one of the first through the third compressors is driven by the mechanical energy developed by at least one of the Claude turbine and the second turbine.

26. An installation according to claim 25, wherein said third compressor is driven by the mechanical energy developed by at least one of the Claude turbine and the second turbine.

* * * * *